US006340272B1

(12) United States Patent
Runge et al.

(10) Patent No.: US 6,340,272 B1
(45) Date of Patent: Jan. 22, 2002

(54) METHOD FOR CONSTRUCTING AN OFFSHORE PLATFORM

(75) Inventors: Karl H. Runge, Houston; George F. Davenport, Cypress, both of TX (US)

(73) Assignee: ExxonMobil Upstream Research Co., Houston, TX (US)

( * ) Notice: Subject to any disclaimer, the term of this patent is extended or adjusted under 35 U.S.C. 154(b) by 0 days.

(21) Appl. No.: 09/478,628

(22) Filed: Jan. 5, 2000

Related U.S. Application Data

(60) Provisional application No. 60/115,085, filed on Jan. 7, 1999.

(51) Int. Cl.[7] ..... B63B 35/44

(52) U.S. Cl. ..... 405/203; 405/195.1; 405/205; 114/264; 114/256

(58) Field of Search ..... 405/195.1, 196, 405/200, 203, 204, 205, 206, 207, 209, 211; 114/256, 264, 265, 266

(56) References Cited

U.S. PATENT DOCUMENTS

| | | | | | |
|---|---|---|---|---|---|
| 3,797,438 | A | * | 3/1974 | Fayren | 114/265 |
| 3,949,564 | A | * | 4/1976 | Nord | 405/205 |
| 4,167,148 | A | * | 9/1979 | Fayren | 114/265 |
| 4,267,788 | A | * | 5/1981 | Blanco | 114/264 |
| 4,360,291 | A | * | 11/1982 | Cranberg et al. | 405/205 |
| 5,292,207 | A | * | 3/1994 | Scott | 405/207 |
| 5,525,011 | A | | 6/1996 | Huang | 405/223.1 |
| 5,791,819 | A | | 8/1998 | Christiansen | 405/224 |
| 5,924,822 | A | * | 7/1999 | Finn et al. | 405/209 |
| 6,139,224 | A | * | 10/2000 | Michel et al. | 405/209 |

OTHER PUBLICATIONS

"Float–over techniques for spar installation", OFFSHORE (Jul. 1998) p. 22.

"Float–over Deck Development", Aker Maritime News, a publication of Aker Maritime, Inc., vol. 3, Issue 1 (2nd Quarter 1998), p. 9.

Hartell, William David and Beattie, S. Michael. "Integrated, Float–over Deck Design Considerations", Offshore Technology Conference, Houston, Texas (May 6–9, 1996) Paper No. OTC 8119, pp. 15–30.

* cited by examiner

*Primary Examiner*—David Bagnell
*Assistant Examiner*—Frederick L. Lagman
(74) *Attorney, Agent, or Firm*—Kelly A. Morgan; Gary P. Katz

(57) ABSTRACT

This invention provides a method for constructing an offshore platform by mating a self-floating deck structure with a self-floating substructure. The self-floating deck structure may be a floating pier or barge, on which the desired equipment has been mounted. Mating is achieved by at least partially submerging the substructure, positioning the pier or barge above it, and deballasting the substructure to create a vertical bearing force between the substructure and the pier or barge. Horizontal force may be transmitted between the deck and substructure by a variety of mechanical, structural, and magnetic means.

30 Claims, 4 Drawing Sheets

METHOD FOR CONSTRUCTING AN OFFSHORE PLATFORM

This application claims the benefit of U.S. Provisional Application No. 60/115,085 filed Jan. 7, 1999.

FIELD OF THE INVENTION

This invention relates generally to the field of offshore platform structure design and construction and, in particular, to a novel method for mating a production and/or drilling deck with a self-floating substructure.

BACKGROUND OF THE INVENTION

Offshore platforms have been used to expand oil and gas exploration and production to various offshore environments. As platforms have been placed in deeper water and in more hostile environments, designs have been modified to adapt to those environments, often involving larger substructure and decks. In order to reduce construction and commissioning time and costs for increasingly complex decks, the deck portion of a platform may be constructed separately from the substructure and then the two sections "mated" to complete the platform construction.

Much of the current technology for mating a deck with a self-floating substructure was developed in the early 1970s with the introduction of North Sea gravity based structures (GBS). A GBS is a large structure designed to be towed to the installation location, where it is ballasted down and held in place on the sea floor by the force of gravity. Generally, North Sea GBSs support large production facilities that are not economically feasible to install by conventional lifting methods developed for steel jacket structures. The smaller production equipment for steel jackets, such as are used in the Gulf of Mexico, is often lifted into place with crane barges once the jacket is in place. In the North Sea, the large production modules and the severe wave environment made it impossible to use early conventional lifting methods for deck installations-crane barges capable of significantly heavier lifts are now available. As a consequence of this difficulty, the GBS concept evolved.

One of the main features of the GBS concept is its capacity for carrying large deck payloads during the ocean tow to the installation site. Decks used with GBSs generally consist either of production and drilling equipment modules along with a module support frame (MSF) or of an integrated deck that combines the equipment with the deck structure into an integrated unit. The deck assembly typically takes place on a pier or on purpose-built supports. Once completed, two to four special barges lift the deck off the pier or supports by deballasting the barges and then transport the deck to deeper water where the partially or wholly submerged GBS is ready for the deck transfer. Transfer to the support towers of the GBS is accomplished by deballasting the GBS and/or ballasting the barges. After the deck is transferred, the GBS is deballasted to the tow draft and prepared for the ocean tow.

The disadvantages of the North Sea GBS deck installation method are: 1) the cost associated with the use of the deck transport barges; 2) costs associated with construction of temporary piers and supports; 3) potential cost penalties associated with strengthening of the MSF or integrated deck to accommodate load reversals as a result of the deck transfer to the GBS; 4) potential construction delays when appropriate deck transport barges are not readily available; and 5) restricted weather conditions for towing multi-barge units.

In other situations, topsides facility installations have involved lifting of decks or modules onto the substructure once the substructure has been installed at the desired location. These lifts are generally performed by heavy-lift crane vessels, which, due to limited availability, can be very expensive and difficult to schedule, especially for larger decks. Following the lifts, offshore hook-up and commissioning activities may require several months for completion. Decks designed for crane-lift installation require significantly more steel in the MSF to withstand the lifting forces.

The integrated deck concept was developed to reduce the time and cost of offshore construction by building the deck as a single integrated unit and completing the majority of hook-ups prior to mating the deck with the substructure. Various techniques for such mating have been developed, including the Brown and Root Hi-deck and other float-over installation concepts. Float-over installation concepts in general involve loading the completed deck structure onto a transport barge, positioning the barge between the legs of the platform substructure, ballasting the barge down to mate the deck with the substructure, and removing the barge. Much engineering effort has gone into developing methods for reducing the load shifts caused by barge movement during the mating. A deck installed with one of the float-over methods requires less steel than is required to accommodate lifting stresses, but some extra structural steel is still required to accommodate the load shifts during both the initial loading onto a barge and the subsequent transfer of the load between the barge and the platform substructure.

While many applications of the integrated deck concept involve bringing a barge in between the legs of an offshore platform, another alternative for deck installation has been the use of catamaran and U-shaped vessels and barges to support the deck for mating with a single-column or other comparatively narrower substructure. Jacks may be used to raise the deck above the top of the substructure, allowing it to then be lowered into the desired installation position. As with the other float-over techniques, the barge is subsequently removed.

While the currently available techniques have reduced platform construction costs, there is still a need for a more cost-effective way to mate a production and/or drilling deck with a self-floating substructure.

SUMMARY OF THE INVENTION

This invention provides a method for constructing an offshore platform by combining a self-floating substructure with a self-floating deck structure. First, a self-floating offshore platform deck structure constructed with a mating surface on the bottom and a self-floating platform substructure with a mating surface on the top are obtained. In the preferred embodiment, mating is achieved by at least partially submerging the substructure, positioning the self-floating deck section above it, and then adjusting the buoyancy of either or both sections to create a bearing force between the upper and lower mating surfaces. Once mated, the substructure may be raised for towing to the installation site, at which it may be installed as either a bottom-founded or a floating platform.

BRIEF DESCRIPTION OF THE DRAWINGS

The present invention and its advantages will be better understood by referring to the following detailed description and the attached drawings in which.

DETAILED DESCRIPTION OF THE INVENTION

The present invention will be described in connection with its preferred embodiments. However, to the extent that the following description is specific to a particular embodiment or a particular use of the invention, this is intended to be illustrative only, and is not to be construed as limiting the scope of the invention. On the contrary, it is intended to cover all alternatives, modifications, and equivalents that are included within the spirit and scope of the invention, as defined by the appended claims.

In its preferred embodiments, the inventive method provides for a novel, more cost-efficient, and less schedule-sensitive deck installation method than is currently available for self-floating structures. General benefits of the invention are elimination of temporary assembly piers or supports and deck transport barges, as well as a substantial size and weight reduction of module steel or module support frame. Instead of using traditional deck mating methods, a floating pier or barge is used as a base for the equipment modules during assembly, hook-up, commissioning, and deck mating. Modules and equipment would be permanently affixed to and/or integrated into the pier, incorporating the pier as part of the completed deck structure. Barge or pier dimensions may be determined in part by the requirements for equipment desired to be located within rather than atop the barge or pier. Ballasting may be used to allow equipment modules to be skidded on during the deck fabrication. When the deck is complete, the floating pier with the equipment modules is joined with the self-floating substructure.

This invention is suitable for any production and/or drilling platform that is self-floating during construction and installation, including gravity-based structures, semi-submersibles, tension-leg platforms, spars, and deep draft caisson vessels, for example. For the purposes of this application "self-floating" shall not be deemed to require that the structure float in its final installed position, but only refers to the step of mating the deck with the substructure.

Although use of a floating pier, as described above, is one method that allows construction of a self-floating deck structure, a preferred embodiment is to use a barge as a base for constructing a self-floating deck. Using a barge allows incorporation of various non-hazardous systems such as water pumps and storage facilities within the barge itself. Ballasting facilities can also be used for storage after deck installation is complete. As will be discussed below, although flat-bottomed barges are the easiest to design for, other shapes may be accommodated. Alternatively, conventional modules can be connected and plated in to form a self-floating deck unit.

Figure 1:
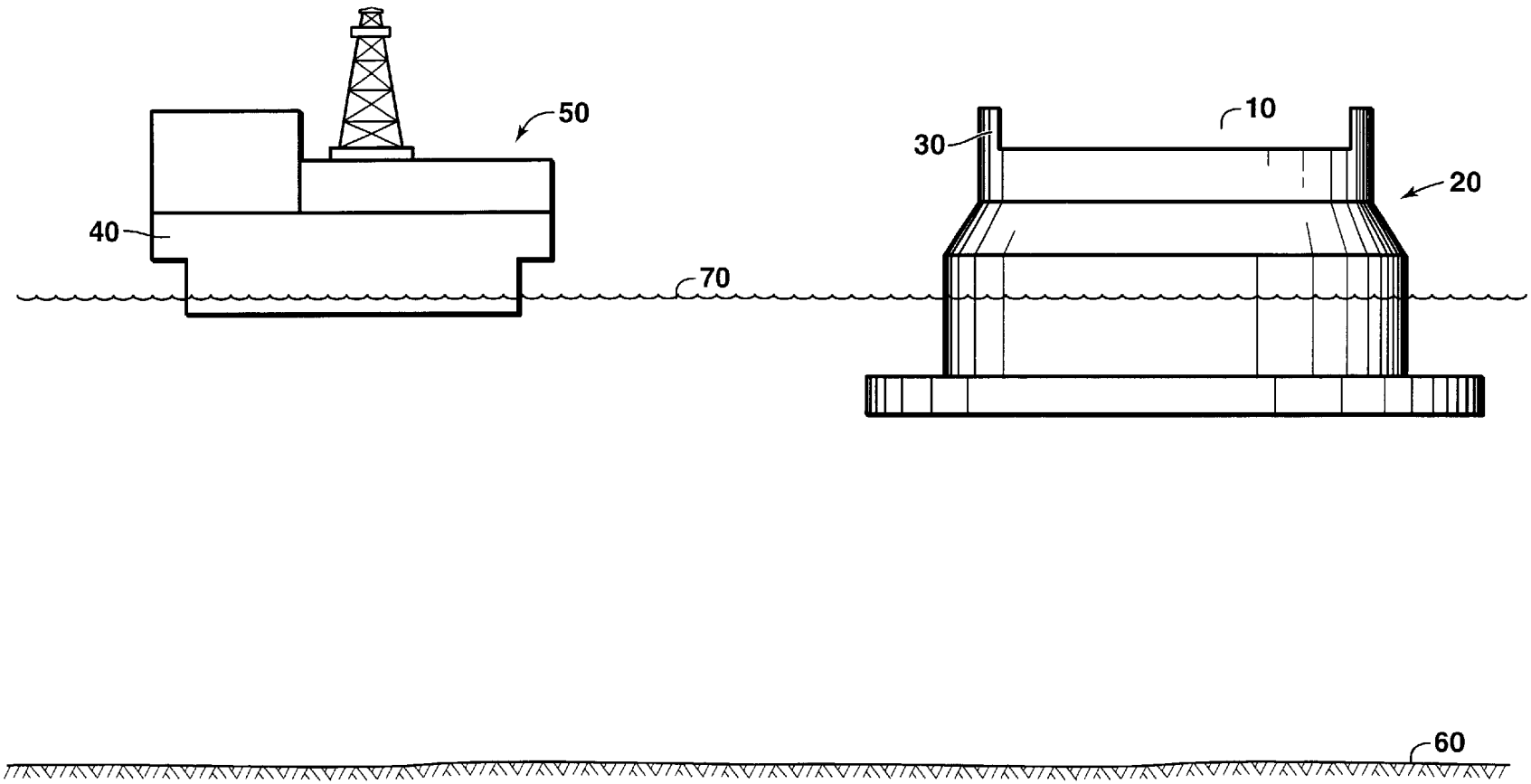
FIG. 1 is an illustration of the deck and substructure sections prior to mating the deck section with a self-floating monolithic substructure having a single column or neck piercing the water surface.
Figure 4:
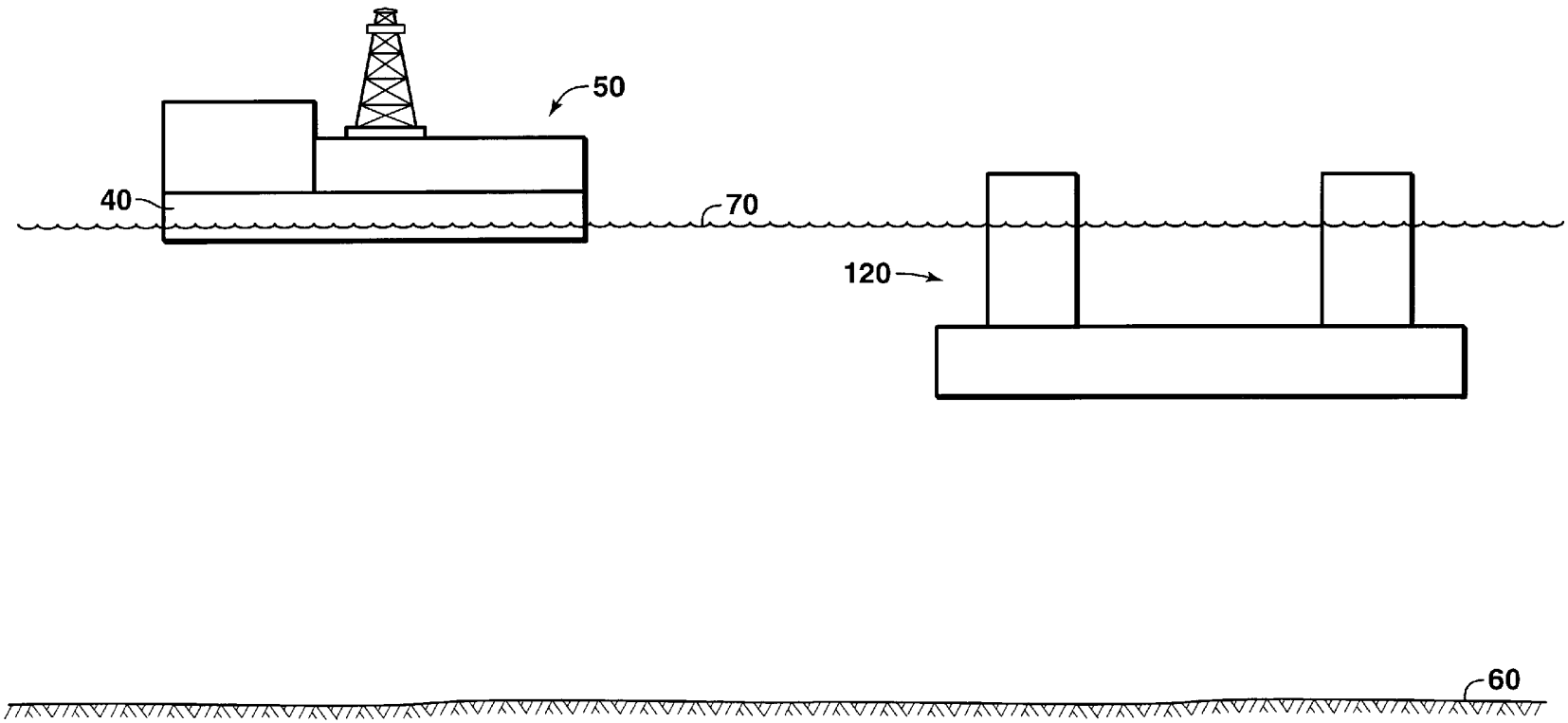
FIG. 4 is an illustration of the deck and substructure sections prior to mating the deck section with a self-floating substructure having multiple deck-support legs.
Figure 6:
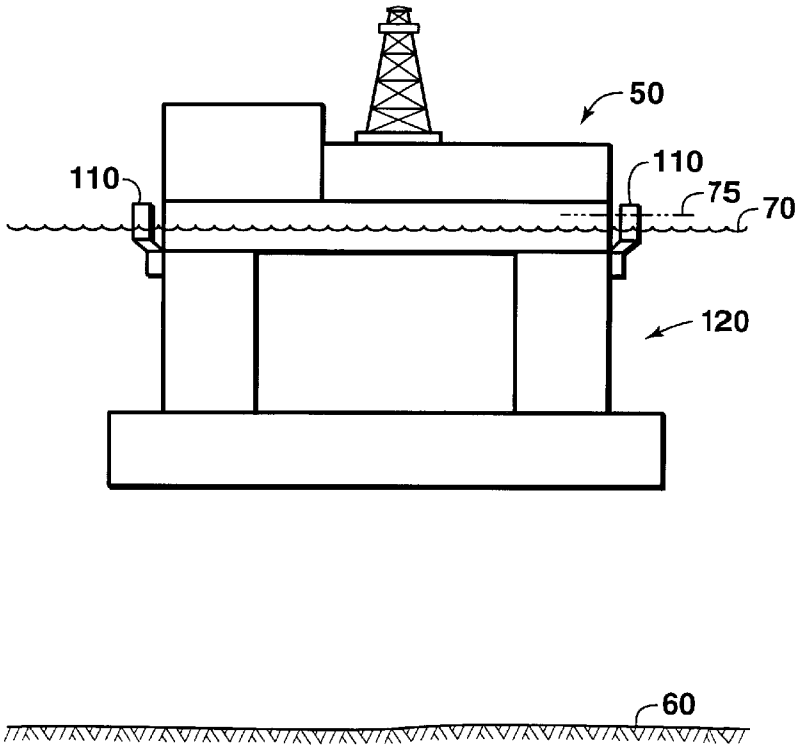
FIG. 6 is an illustration of the mated platform produced by the invention as applied using a substructure with multiple deck-support legs.
Figure 5:
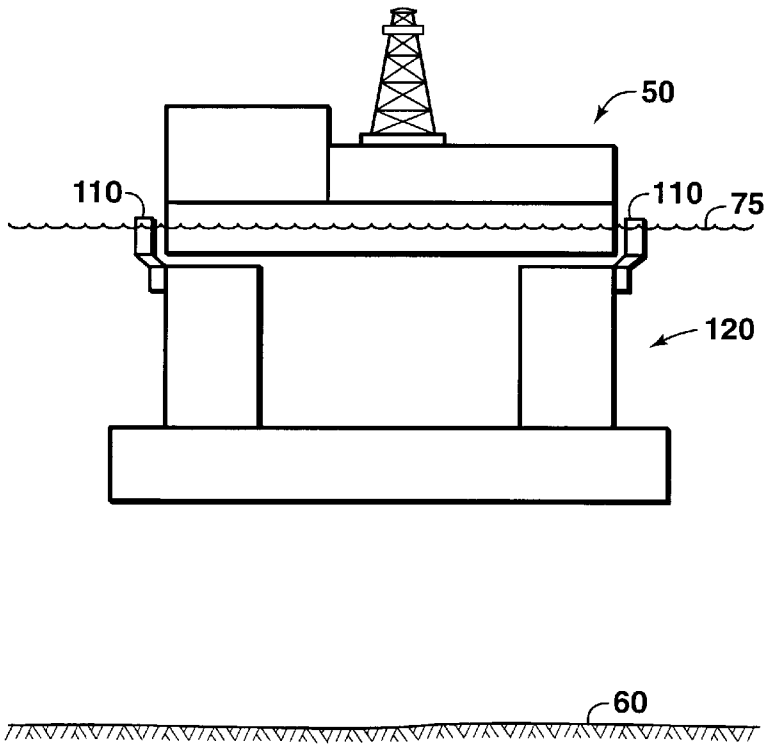
FIG. 5 is an illustration of the mating steps of the invention as applied using a substructure with multiple deck-support legs.

The preferred embodiment for using the invention is to combine the self-floating deck structure, including any pier or barge used for flotation, with a purpose-built substructure. It will be recognized that it would also be possible to obtain and use certain existing substructures with or without modification. The term "obtain" will be used inclusively to mean either fabrication of a new substructure or use, including modification if necessary, of a previously existing substructure. As illustrated in FIG. 1, combining the self-floating deck structure with a self-floating substructure would entail construction of a sufficiently wide channel 10 at the top of a caisson or spar-type GBS 20 for the deck to float into. The wingwalls 30 on either side of the channel provide a waterplane and, hence, floating stability, when the substructure is submerged to float the pier or barge 40 carrying the deck 50 over the substructure. Alternatively, as shown in FIGS. 4 through 6, the floating stability could be provided by the use of sponsons 110 if the self-floating substructure comprises multiple support legs 120. The sponsons may be removed following mating.

Figure 3:
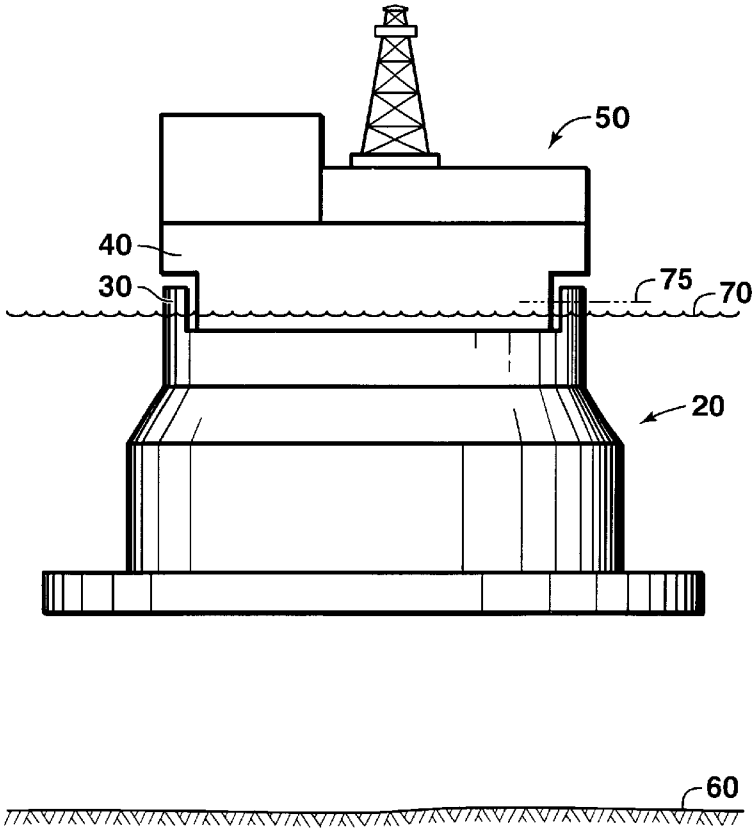
FIG. 3 is an illustration of the mated platform produced by the invention as applied using a monolithic substructure with a single column or neck piercing the water surface.
Figure 2:
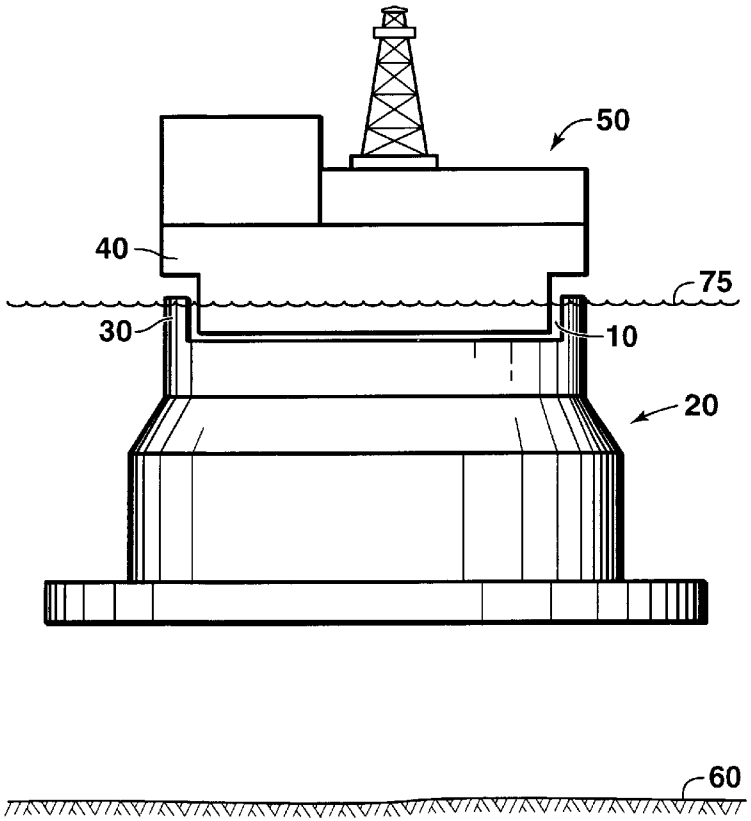
FIG. 2 is an illustration of the mating steps of the invention as applied using a monolithic substructure with a single column or neck piercing the water surface.

Deck assembly, hook-up, commissioning, and mating pose a particular problem for caisson structures that are too wide to easily accommodate a catamaran deck-mating. Such structures are typical of those developed for shallow-water arctic and subarctic applications. The example application shown in FIG. 1 is for an island production structure which comprises a caisson-like substructure 20 and a deck 50 that is constructed or assembled on a barge-like structure 40 or is self-floating. The bottom of the channel or opening comprising a lower mating surface is substantially submerged (waterline at 75 in FIG. 2) to allow the pier, barge, or deck to be floated into the channel or opening. FIG. 2 illustrates the step in which the production deck, including the associated pier or barge, is then floated over the substructure so that the upper mating surface on the deck is aligned with the substructure in such a way that mating can occur. The substructure is then deballasted to engage the deck, thus forming a single unit during tow and for installation offshore as is shown in FIG. 3 with the waterline now at 70. In this example, much of the hook-up between the substructure and the deck could be incorporated within the wingwalls or within vertically aligned moonpools built into the deck and substructure.

Another example application, as shown in FIGS. 4 through 6, is to use temporary additional buoyancy provided by sponsons 110 or other means to completely or almost completely immerse the substructure (waterline shown at 75 in FIG. 5), allowing the production deck to be floated over the substructure without a constructed channel or opening. The substructure 120 is then deballasted to engage the production deck. Once load from the floating production deck is partially transferred to the substructure, the combined deck and sponson waterplane will provide sufficient additional stability to continue deballasting until the deck is out of the water. Further deballasting continues until the towing draft is reached as shown in FIG. 6 with the waterline now shown at 70. At this point, the temporary buoyancy can be removed, and, if required, used for another application. Although towing is presumed in these examples, it will be recognized that the inventive method could also be applied at the installation location for floating platforms or nearby in slightly deeper water for platforms intended to rest on the sea floor (shown at 60 in FIGS. 1 through 6).

Some major advantages of this invention are: 1) a substantially self-floating deck or deck assembled on a barge-like structure can be installed on a substructure of large dimensions; 2) a self-floating deck, more or less uniformly supported on a substructure, can substantially reduce or eliminate primary structural support material in the deck, reducing costs and permitting flexibility to configure, lay out, construct, and install a deck on a substructure of large dimensions; and 3) additional barges are not required for deck mating.

The invention is particularly well suited for large self-floating caisson-like substructures with large deck loads to be deployed in ice environments. To ensure adequate foundation capacity against severe ice loading generally requires a large self-floating substructure, which, because of its size, is well suited to support a barge or self-floating pier. One option for deck support is to contain the barge or pier within the confines of the upper caisson section, although, if cost or technical advantages can be derived, partial cantilevering of the barge or pier is feasible. A cantilevered deck may require raising the deck structure higher to avoid wave and ice action, which in turn may increase substructure requirements.

Although some clearance is all that is required for a successful deck installation under ideal conditions, the preferred channel width to allow mating under less stringently controlled circumstances would be approximately 2 meters (about 6 feet) greater than the barge width or greater, the preferred channel depth would be sufficient to ensure at least 0.5 meters (about 1.5 feet) underkeel clearance of the floating barge, and the channel walls would preferably extend at least 3 meters (about 9 feet) above the water level when the barge enters the channel. The preferred clearances above are based on anticipated manufacturing tolerances and will need to be adjusted appropriately for situations in which sea conditions are uncertain or late design or weight changes are anticipated.

Once the barge is inside the channel, the substructure is deballasted to lift the barge out of the sea and to reach the desired towing draft. Simultaneously or alternatively, the barge could be ballasted down to the level of the substructure. In either situation, ballast could subsequently be adjusted to achieve the desired towing or installation draft. The bottom of the channel provides nearly uniform support once the barge with the deck equipment is in place. The bearing pressure between the bottom of the barge and the channel governs the capacity to resist limited wave and ice loads against the barge at the channel opening. The resistance can be increased if necessary, for example by adding water or sand ballast inside the barge or by using mechanical shear keys 25. Alternative methods of securing the pier or barge to the substructure include mechanical fasteners, welded connections (especially for substructures with support legs), or magnetic locking devices, any of which may be used to secure all or a portion of the upper mating surface to a corresponding area of the lower mating surface. In the channel example, a padding layer of polyurethane foam or other material may be used to distribute the bearing force more evenly as well as increasing the friction forces.

Although maximum frictional resistance is obtained through maximum contact between the barge and the channel, it will be understood that alternative shapes may be used which may, in some instances, reduce the surface area in contact between the two mating surfaces. Possible shapes will include any shape that may be defined by the bottom of a barge or floating pier, specifically including any combination of flat or curved surfaces. While it is generally desirable to match the shapes of the lower mating surface defined by the shape of the channel and upper mating surface on the barge or pier, sufficient contact to allow a stable platform is all that is required. Depending on the application, the contact could be between columns or protrusions on the substructure and specific points or receptacles on the barge. The lower mating surface may comprise the upper ends of, preferably, at least three legs spaced so as to accommodate and provide support for a self-floating offshore platform deck structure.

Although the embodiments discussed above are primarily related to the beneficial effects of the inventive process when applied to arctic installations, this should not be interpreted to limit the claimed invention, which is applicable to any situation in which a deck must be installed on a self-floating platform substructure.

What we claim is:

1. A method for constructing an offshore platform, said method comprising the steps of:

a) constructing a self-floating offshore platform deck structure, the bottom of said self-floating deck structure comprising an upper mating surface;

b) obtaining a self-floating platform substructure, the top of said self-floating platform substructure comprising a lower mating surface;

c) at least partially submerging the platform substructure until there is sufficient clearance to position the self-floating deck structure above said platform substructure;

d) positioning said upper mating surface over said lower mating surface while both said self-floating deck structure and said self-floating platform substructure are floating; and e) adjusting the buoyancy of at least one platform section so as to create a bearing force, while said upper mating surface and said lower mating surface are located below the water surface, between said upper mating surface and said lower mating surface.

2. The method of claim 1 wherein the self-floating offshore platform deck structure is constructed by constructing a platform deck on a floating pier.

3. The method of claim 2 wherein the floating pier is a barge.

4. The method of claim 1 further comprising using sponsons to stabilize the platform substructure when it is at least partially submerged.

5. The method of claim 1 wherein the platform substructure is a gravity-based structure.

6. The method of claim 1 further comprising using mechanical fasteners to secure the upper mating surface to the lower mating surface.

7. The method of claim 1 further comprising using structural shear keys to secure the upper mating surface to the lower mating surface.

8. The method of claim 1 further comprising using welded connections to secure at least a portion of the upper mating surface to at least a portion of the lower mating surface.

9. The method of claim 1 further comprising using magnetic forces to secure at least a portion of the upper mating surface to at least a portion of the lower mating surface.

10. The method of claim 1 wherein the lower mating surface is a channel formed in the upper portion of said self-floating platform substructure and shaped so as to accommodate said self-floating offshore platform deck structure.

11. The method of claim 10 wherein the width of said channel is at least about 2 meters greater than the width of said mating surface of said upper self-floating offshore platform deck structure.

12. The method of claim 10 wherein the lower mating surface is positioned so as to allow at least 0.5 meters clearance when the upper mating surface is positioned over said lower mating surface.

13. The method of claim 10 wherein the walls of said channel extend at least 3 meters above the water level when the self-floating offshore platform deck is positioned above said self-floating platform substructure.

14. The method of claim 1 wherein the lower mating surface comprises the upper ends of at least three legs spaced sufficiently to support said self-floating offshore platform deck structure.

15. An offshore platform constructed using the method of claim 1.

16. A method for constructing an offshore platform, said method comprising the steps of:

a) fabricating an upper platform section by constructing a platform deck on a floating pier, the bottom of said floating pier comprising an upper mating surface;

b) obtaining a self-floating platform substructure, the top of said self-floating platform substructure comprising a lower mating surface;

c) ballasting said self-floating platform substructure sufficiently to allow positioning said upper mating surface over said lower mating surface;

d) positioning said upper mating surface over said lower mating surface while both said self-floating deck structure and said self-floating platform substructure are floating; and e) deballasting the platform substructure so as to create a bearing force, while said upper mating surface and said lower mating surface are located below the water surface, between said upper mating surface and said lower mating surface.

17. The method of claim 16 further comprising adding weight to the floating pier so as to enhance the bearing force created between said upper mating surface and said lower mating surface.

18. The method of claim 16 wherein the floating pier is a barge.

19. The method of claim 16 further comprising using sponsons to stabilize the platform substructure when it is ballasted down.

20. The method of claim 16 wherein the platform substructure is a gravity-based structure.

21. The method of claim 16 further comprising using mechanical fasteners to secure the upper mating surface to the lower mating surface.

22. The method of claim 16 further comprising using mechanical shear keys to secure the upper mating surface to the lower mating surface.

23. The method of claim 16 further comprising using welded connections to secure at least a portion of the upper mating surface to at least a portion of the lower mating surface.

24. The method of claim 16 further comprising using magnetic forces to secure at least a portion of the upper mating surface to at least a portion of the lower mating surface.

25. The method of claim 16 wherein the lower mating surface is a channel formed in the upper portion of said self-floating platform substructure and shaped so as to accommodate said floating pier.

26. The method of claim 25 wherein the width of said channel is at least about 2 meters greater than the width of said upper mating surface of said floating pier.

27. The method of claim 25 wherein the lower mating surface is positioned so as to allow at least 0.5 meters clearance when the upper mating surface is positioned over said lower mating surface.

28. The method of claim 25 wherein the walls of said channel extend at least 3 meters above the water level when the floating pier enters said channel.

29. The method of claim 16 wherein the lower mating surface comprises the upper ends of at least three legs spaced sufficiently to support said floating pier.

30. An offshore platform constructed using the method of claim 16.

* * * * *